United States Patent [19]

Darnell

[11] Patent Number: 4,878,410

[45] Date of Patent: Nov. 7, 1989

[54] PAPER ROLL SPLITTER

[76] Inventor: Hoyt C. Darnell, 44 Knapp St., Livermore Falls, Me. 04254

[21] Appl. No.: 170,545

[22] Filed: Mar. 21, 1988

[51] Int. Cl.[4] ..... B26D 5/12

[52] U.S. Cl. ..... 83/635; 83/639.1; 83/924; 83/928

[58] Field of Search ..... 83/924, 928, 614, 635, 83/639

[56] References Cited

U.S. PATENT DOCUMENTS

| | | | |
|---|---|---|---|
| 2,752,998 | 7/1956 | Ferguson | 83/924 |
| 3,160,044 | 12/1964 | Somerville | 83/924 |
| 3,675,525 | 7/1972 | Ellison | 83/924 |
| 3,818,587 | 6/1974 | Williams | 83/924 |
| 4,020,726 | 5/1977 | Coats | 83/924 |
| 4,327,617 | 5/1982 | Budzitit et al. | 83/928 |
| 4,445,557 | 5/1984 | Peters, III | 83/928 |
| 4,476,761 | 10/1984 | Bird | 83/924 |

*Primary Examiner*—Frank T. Yost

*Assistant Examiner*—Scott A. Smith

[57] ABSTRACT

A paper roll splitter attachment of the guillotine type is provided for mounting on the vertically movable assembly of a fork-lift type vehicle. It includes a frame and means for attaching its back to the above-mentioned vertically movable assembly. A pair of horizontal mutually spaced lifting arms extend outwardly from the bottom of the front side of the frame for receiving a roll to be split. A pair of spaced parallel rails extend downwardly in a diagonal plane from the top of the assembly, connecting the upper portion thereof to the extermities of the arms. A cutting blade is slidably mounted on the rails for reciprocating motion. Hydraulic rams reciprocate the blade in its diagonal path. Upwardly facing hooks on the ends of the arms receive and hold the opposite ends of a shaft through the roll core, whereby the roll can be lifted and transported to a desired location for splitting by the blade being driven guillotine-wise into it by the rams.

7 Claims, 3 Drawing Sheets

PAPER ROLL SPLITTER

This invention relates to splitting of paper rolls for the purpose of returning the paper to pulp.

BACKGROUND OF THE INVENTION

It has previously been proposed to provide movable roll splitters to replace permanently mounted guillotine-type splitters to which the rolls had to be transported. One example is disclosed in Coats U.S. Pat. No. 4,020,726 and another in Bird U.S. Pat. No. 4,476,761 to which reference may be had for background information concerning this technology.

Coats discloses a splitter of the guillotine type mounted on a wheeled cart. It is provided with a pair of generally horizontal holding arms which may be tilted upwardly or downwardly by a hydraulic cylinder. A cutter blade is reciprocable on the arms in a generally horizontal plane. The cart is moved to the roll and downwardly facing hooks on the ends of the arms are hooked onto the ends of a shaft through the core of the roll. The paper roll is then split by the blade. The roll is never lifted and cannot be suspended over a well leading to the pulper into which the cut paper could drop.

Bird, on the other hand, provides a mobile splitter of the non-guillotine type having a horizontal outwardly facing vertically movable spline on the end of a fork-lift type truck. The truck is driven to the roll and the spline inserted through the roll core. The roll is lifted by the spline and carried to a desired location, which may be over a beater, bailer, belts, etc., for disposal of the cut paper. The roll is split by a horizontally reciprocable knife which travels lengthwise of the roll cutting deeper into it at each pass.

BRIEF DESCRIPTION OF THE INVENTION

It is the object of the invention to provide a specific improvement over the two above-described prior devices and which provides the advantages of both and none of the disadvantages.

In accordance with the invention, there is provided a paper roll splitter attachment of the guillotine type for mounting on the vertically movable assembly of a fork-lift type vehicle. The attachment includes a frame and means for attaching its back to the above-mentioned vertically movable assembly to be raised and lowered therewith. A pair of generally horizontal mutually spaced lifting arms extend outwardly from the bottom of the front side of the frame. The spacing between these arms is at least as great as the length of the roll to be split. A pair of spaced parallel rails extend downwardly in a diagonal plane from the top of the assembly, connecting the upper portion thereof to the extremities of the arms. A cutting blade is slidably mounted for reciprocation in a path parallel to said diagonal plane with its cutting edge facing outwardly and downwardly in said plane. Hydraulic ram means are mounted on the frame in driving relation to the blade for bodily reciprocating the latter in its said path. Finally, means are provided on the ends of the arms for lifting engagement with the opposite ends of a shaft extended through the core of a paper roll. Thus, the vehicle may be driven to the location of a paper roll to be split with the arms straddling the roll endwise, the roll engaged and lifted by its core shaft, transported to a desired location and there split by the blade being driven radially into it by the ram means.

In preferred embodiments, the means on the ends of the arms for engaging the core shaft comprise upwardly facing hooks adapted to receive the opposite end portions of the shaft, the ram means is powered by the hydraulic system of the vehicle, and the ram means comprises a pair of parallel hydraulic rams located in the plane of the path of blade travel, one end of each being fixed to the top of the frame and the other end connected in driving relation to the blade.

Still further objects, features and advantages of the novel splitter of the invention will become apparent from the following detailed description of a presently preferred embodiment thereof taken in conjunction with the accompanying drawings.

DETAILED DESCRIPTION OF PREFERRED EMBODIMENT

Figure 1:
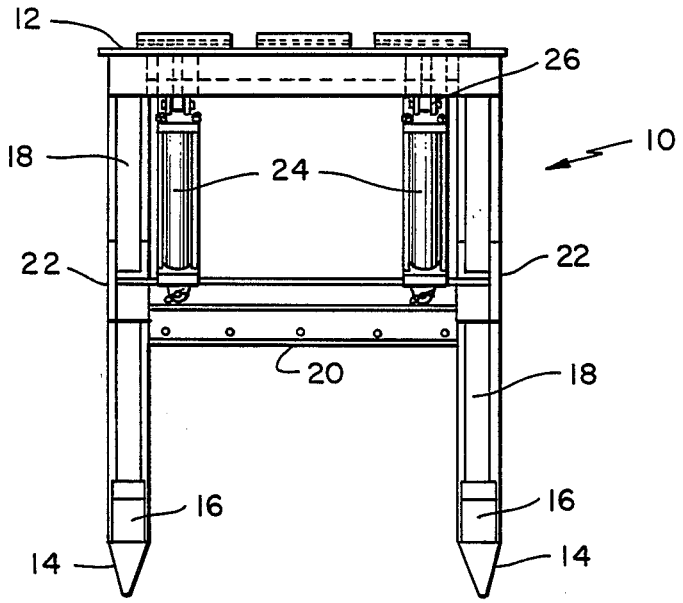
FIG. 1 is a front elevation of the roller splitting attachment of the invention.
Figure 2:
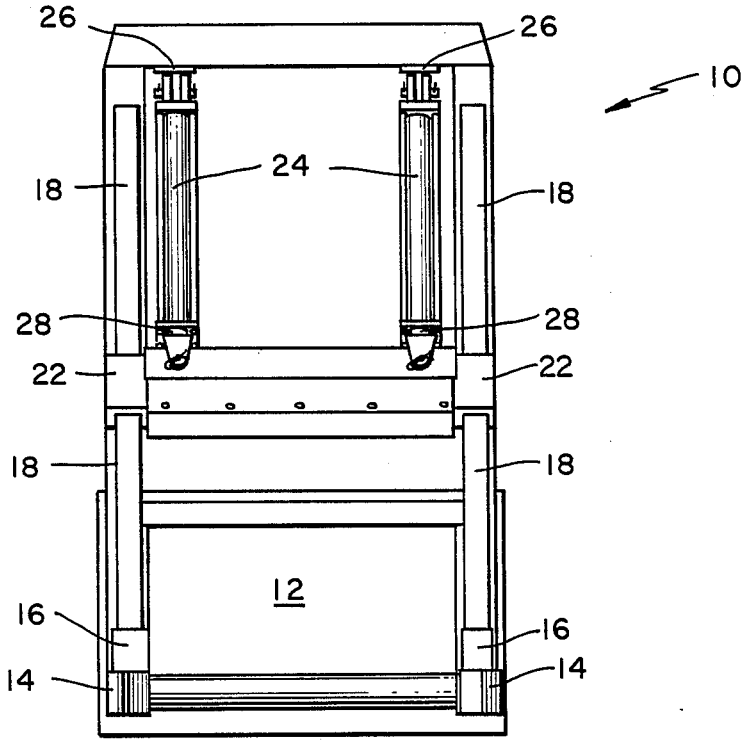
FIG. 2 is a plan view of the same.
Figure 3:
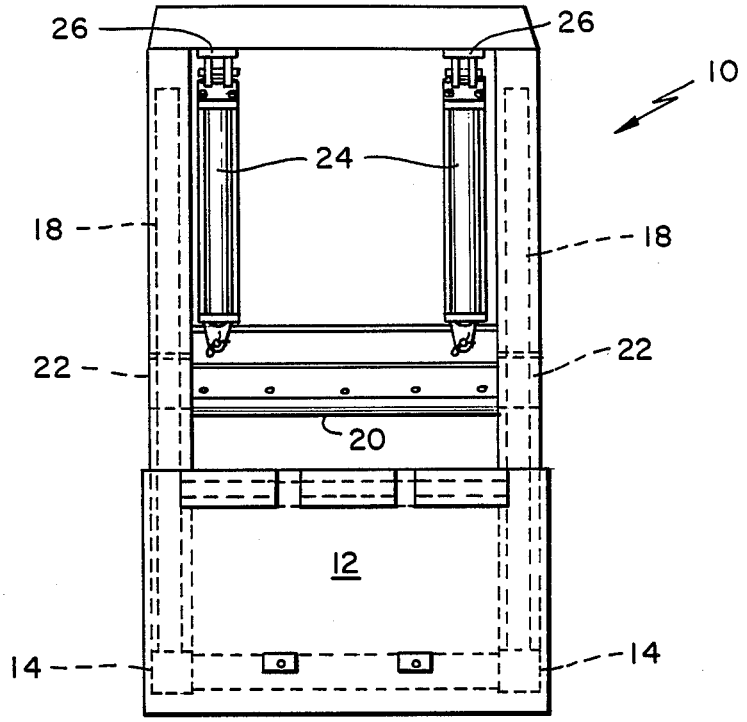
FIG. 3 is a rear elevation.
Figure 4:
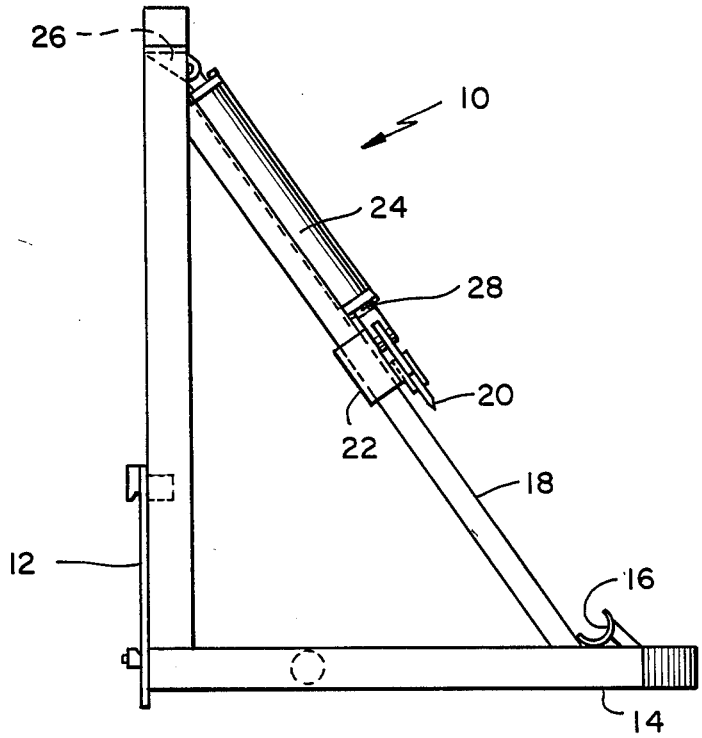
FIG. 4 is a side view.
Figure 5:
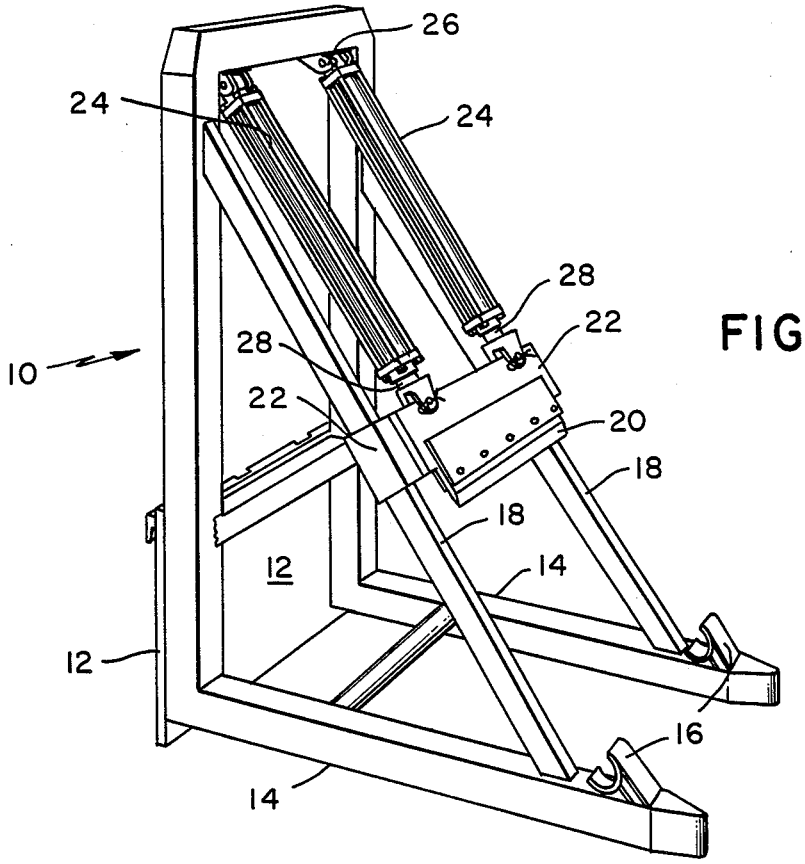
FIG. 5 is a view in perspective.

The novel splitter attachment comprises a main frame 10 having a rearwardly facing square upright panel 12 and a pair of parallel arms 14 extending forwardly from the bottom of the panel 12. The outer extremities of the arms 14 are provided with upwardly facing hooks 16. A pair of parallel diagonal rails 18 extend between the top of the panel 12 and the forward end portions of each of the arms. These rails not only provide reinforcement for the arms but also define the cutting path for the cutter blade.

Located between the arms 18 is a cutting blade 20 which may slide up and down on the arms by means of slide mounts 22. The cutting edge of the blade faces diagonally downwardly in a plane parallel to the plane of the rails 18.

Driving the blade 20 are two hydraulic rams 24. The upper end of the cylinder of each is connected to the top member 26 of panel 12 and the cylinder rods 28 are connected in driving relation to the blade 20.

The rear face of the panel 12 is adapted for mounting on the vertically movable assembly 30 of the fork-lift type vehicle 32 (shown in phantom).

Operation

Figure 6:
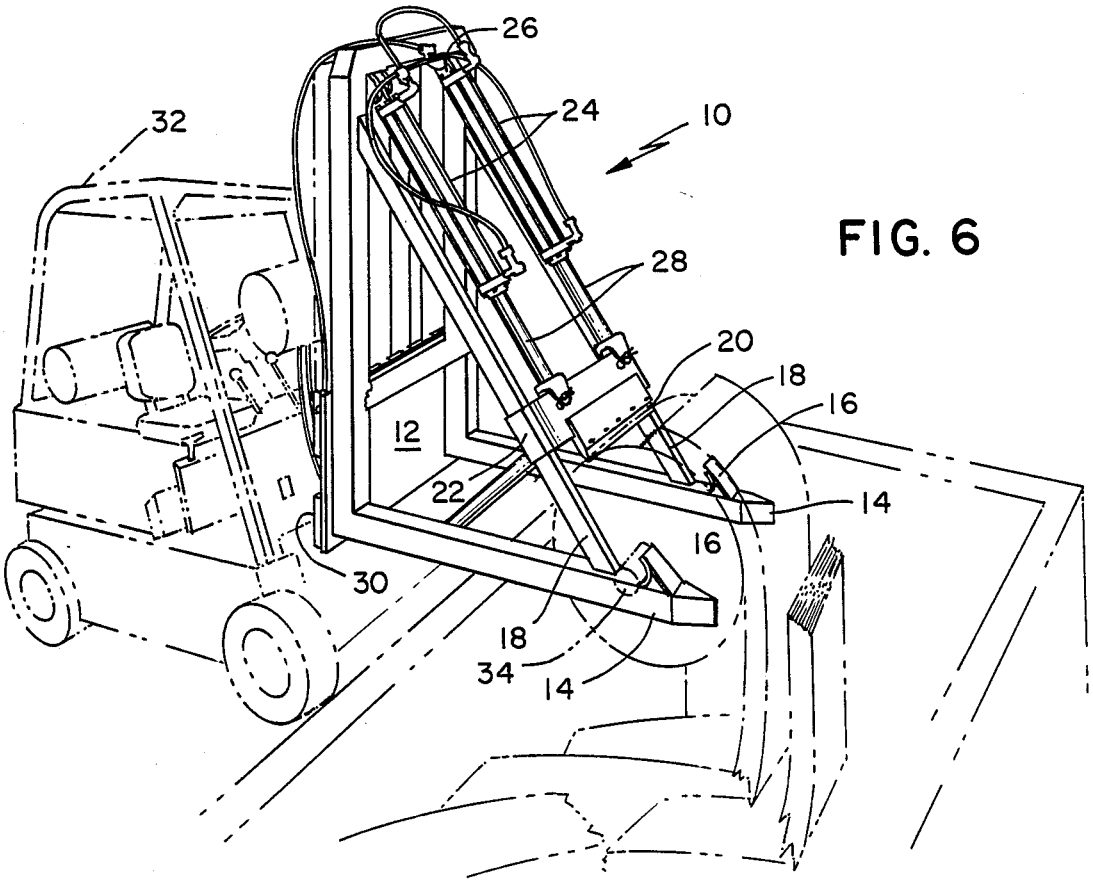
FIG. 6 is a perspective of the splitter similar to FIG. 5 attached to the working end of a fork-lift type truck (shown in phantom) holding a broke roll (also shown in phantom) to be split over a well into which the split paper is dropper.

When a broke roll is to be split and its paper returned to pulp, the vehicle is driven to the roll. A shaft 34 is inserted through the roll core and then the arm ends, straddling the roll endwise, are positioned with the hooks 16 under opposite end portions of the shaft. The frame is then lifted by the vehicle lift mechanism and the roll transported to a desired location, which may be over a chute shown in phantom in FIG. 6 into which paper to be repulped is to be fed. With the roll properly positioned, the guillotine-type blade 20 is advanced by the rams to cut lengthwise radially into the roll, severing successive layers of paper which drop into the chute.

It should be noted that the device combines the advantages of a simple guillotine-type cutting blade with a roll lifting and transporting feature not present in the prior art referred to above.

While there is herein shown and described a presently preferred embodiment of the invention, it will nevertheless be understood that the same is susceptible of modification and change by those skilled in the art and it is intended that the scope of the invention be limited only by the proper interpretation to be afforded the appended claims.

I claim:

1. A paper roll splitter attachment of the guillotine type for mounting on the vertically movable assembly of a fork-lift type vehicle provided with hydraulically powered lift means for raising and lowering said assembly, comprising a main frame, means for attaching the back of said frame to said vertically movable assembly, a pair of generally horizontal mutually spaced lifting arms extending forwardly from the bottom of the front of said frame to be lifted and lowered therewith, the spacing between said arms being at least as great as the length of the roll to be split, a pair of spaced parallel rails extending downwardly in a diagonal plane from the top of said frame connecting the upper portion of said frame to the outer end portions of said arms, a cutting blade, means slidably mounting said blade on said rails for reciprocating motion in a path parallel to said diagonal plane with its cutting edge facing diagonally downward, hydraulic ram means mounted on said frame in driving relation to said blade for bodily reciprocating the latter in its said path, and means on the outer ends of said arms for lifting engagement with opposite ends of a shaft extended through the core of a paper roll, whereby a roll to be split may be transported between said arms to a desired location and there split by said knife driven into it guillotine-wise by said ram means.

2. The splitter attachment as claimed in claim 1 wherein said means on the outer ends of said arms for engaging and lifting said roll by its said shaft comprise upwardly facing hooks adapted to receive the opposite end portions of the shaft.

3. The splitter attachment as claimed in claim 1 wherein said ram means is powered by the hydraulic system of said vehicle.

4. The splitter attachment as claimed in claim 1 wherein said ram means comprises at least one hydraulic ram in driving relation to said blade for reciprocating it in its said path.

5. The splitter attachment as claimed in claim 3 wherein said ram means comprises at least one hydraulic ram in driving relation to said blade for repiprocating the latter in its said path.

6. The splitter attachment as claimed in claim 5 wherein said ram means comprises a pair of hydraulic rams disposed and arranged to reciprocate said blade in its said path.

7. The splitter attachment as claimed in claim 6 wherein said rams are mounted parallel to each other in the plane of the path of said blade, one end of each being fixed to the top of said frame and the other end of each connected in driving relation to said blade.

* * * * *